US006039205A

United States Patent [19]

Flink

[11] Patent Number: 6,039,205

[45] **Date of Patent: *Mar. 21, 2000**

[54] ERGONOMIC HAND-HELD SHOPPING BASKET

[76] Inventor: Christopher M. Flink, 175 Pfeiffer St., Apt. 4, San Francisco, Calif. 94133

[ * ] Notice: This patent issued on a continued prosecution application filed under 37 CFR 1.53(d), and is subject to the twenty year patent term provisions of 35 U.S.C. 154(a)(2).

[21] Appl. No.: 08/951,828

[22] Filed: Oct. 16, 1997

Related U.S. Application Data

[60] Provisional application No. 60/028,818, Oct. 17, 1996.

[51] Int. Cl.[7] ..... B65D 21/032

[52] U.S. Cl. ..... 220/659; 220/771; 220/676; 220/914; 206/520

[58] Field of Search ..... 220/914, 676, 220/771, 756, 755, 656, 657, 659; 206/515, 519, 510

[56] References Cited

U.S. PATENT DOCUMENTS

| | | | |
|---|---|---|---|
| D. 102,671 | 1/1937 | Worthington . | |
| D. 142,783 | 11/1945 | Jacobson | D58/4 |
| D. 204,787 | 5/1966 | Braun | D44/29 |
| D. 212,995 | 12/1968 | Myers | D87/1 |
| D. 277,993 | 3/1985 | Sinchok | D34/44 |
| D. 283,457 | 4/1986 | Smith | D34/43 |
| D. 326,552 | 5/1992 | Goodell | D34/42 |
| D. 327,562 | 6/1992 | Brightbill | D34/45 |
| D. 329,135 | 9/1992 | Embree | D3/30.1 |
| D. 333,910 | 3/1993 | Rorke | D3/35 |
| D. 347,942 | 6/1994 | Gilbert et al. | D3/308 |
| D. 358,484 | 5/1995 | Cautereels et al. | D3/310 |
| D. 361,664 | 8/1995 | Brown | D3/315 |
| D. 364,039 | 11/1995 | Kruger | D3/315 |
| D. 367,172 | 2/1996 | Brightbill et al. | D3/310 |
| 784,950 | 3/1905 | Lindsay . | |
| 2,314,835 | 3/1943 | Johns et al. | 220/1 |
| 2,549,282 | 4/1951 | Aschbrenner | 220/914 |
| 2,774,511 | 12/1956 | Menkin et al. | 220/97 |

(List continued on next page.)

FOREIGN PATENT DOCUMENTS

| | | | |
|---|---|---|---|
| 1 059 418 | 2/1967 | United Kingdom | 206/510 |
| 2 263 101 | 7/1993 | United Kingdom . | |

OTHER PUBLICATIONS

Product Bulletin entitled SHOP●LITE™ Express Baskets, distributed by B&N Industries, Inc.

*Primary Examiner*—Stephen Castellano
*Attorney, Agent, or Firm*—Seidel, Gonda, Lavorgna Monaco, PC

[57] ABSTRACT

A stackable shopping basket in which the proximal side wall is inwardly curved in a contour adapted to an adult human user's body. The opposite or distal side wall may also be curved with a contour that is symmetrical with the proximate side wall. The side walls and end walls have an outwardly-turned peripheral top edge forming a lip, the lip being extended downward along at least a portion of the proximal side wall to form a cushion portion. Stand-off fins are provided along the periphery of the basket between the lip and the end walls and side walls other than the cushion portion. A centrally located handle projects from the bottom of the basket and defines a channel through the bottom wall of the basket for nesting identical baskets in a stack. The grip of the handle is oriented along the longitudinal axis of the basket. The grip may have a detachable cover to display advertising.

30 Claims, 6 Drawing Sheets

U.S. PATENT DOCUMENTS

| | | | |
|---|---|---|---|
| 2,805,788 | 9/1957 | Allbright et al. | 220/657 |
| 2,821,327 | 1/1958 | Glazer | 206/510 |
| 3,045,862 | 7/1962 | De Chelbor | 220/102 |
| 3,045,863 | 7/1962 | De Chelbor | 220/102 |
| 3,170,594 | 2/1965 | Nascher | 220/97 |
| 3,283,947 | 11/1966 | Cornelius | 220/102 |
| 3,297,196 | 1/1967 | Cornelius | 220/102 |
| 3,326,410 | 6/1967 | Asenbauer | 220/97 |
| 3,392,874 | 7/1968 | Peebles | 220/97 |
| 3,463,353 | 8/1969 | Peebles | 220/97 |
| 3,587,915 | 6/1971 | Theobald et al. | 206/510 |
| 3,907,105 | 9/1975 | Nowak | 206/216 |
| 4,235,331 | 11/1980 | Bates, III et al. | 206/170 |
| 4,373,642 | 2/1983 | Wolters et al. | 220/659 |
| 4,478,344 | 10/1984 | Rehrig | 220/83 |
| 4,579,489 | 4/1986 | Sarantitis | 410/80 |
| 4,660,734 | 4/1987 | Heaney et al. | 206/519 |
| 4,720,021 | 1/1988 | Byrns | 220/94 R |
| 4,930,697 | 6/1990 | Takahashi et al. | 224/275 |
| 4,946,059 | 8/1990 | Rehrig | 220/73 |
| 4,982,863 | 1/1991 | Skillius | 220/318 |
| 5,011,013 | 4/1991 | Meisner et al. | 206/373 |
| 5,086,917 | 2/1992 | Dziersk et al. | 206/510 |
| 5,117,979 | 6/1992 | Brightbill | 206/372 |
| 5,145,082 | 9/1992 | Craft, Jr. et al. | 220/659 |
| 5,251,779 | 10/1993 | Schmidt | 220/659 |
| 5,503,571 | 4/1996 | Cheslock | 439/501 |
| 5,673,811 | 10/1997 | Dickinson et al. | 220/659 |

ERGONOMIC HAND-HELD SHOPPING BASKET

This application claims priority from Provisional Application number 60/028,818 filed Oct. 17, 1996.

FIELD OF THE INVENTION

This invention relates to the general field of hand baskets, and more particularly to stackable hand-held shopping baskets which are used for carrying groceries and other goods in supermarkets and other retail stores.

BACKGROUND OF THE INVENTION

It is common for retail stores to have hand baskets available as a courtesy to their customers for carrying groceries or other items being purchased. Shoppers tend to appreciate the convenience of these hand-baskets, particularly when they do not wish to use large shopping carts. However, hand baskets are often uncomfortable and sometimes even painful to use when heavily loaded.

Hand baskets commonly used in retail settings generally have a rectangular crate-like construction. These baskets usually have one or two pivoting handles which are attached to the long sides of the rectangular basket and extend over the opposite sides to permit stacking. The handles are usually thin strips of wire or plastic, often having a small diameter or a sharp edge which can cut into or pinch the hand, making them uncomfortable to grip and carry as the baskets become filled and heavy.

Most handles do not provide proper balance for carrying a shopping basket. The manner in which these handles are attached to shopping baskets, the long moment arm of the load, and the small diameter of the grip allow the basket to pivot and sway when the shopper is walking, which may cause items to shift in the basket or spill from it. Fragile items within the basket may be damaged if shifting causes impact against a hard surface.

When a basket is carried, and particularly if it is permitted to swing because of the handle design, the edges and corners of traditional rectangular baskets impact the user's body. Because the length of these handles is largely dictated by the size of the basket (as the handles must fold completely out of the way to allow stacking), these baskets often hang low and impact the user's legs in the knee or upper shin area.

When a heavy load is carried in such known baskets, a considerable torque is placed on the user's back, elbow and wrist. The orientation of the handles on existing shopping baskets tends to twist and lock the user's elbow in an uncomfortable position, typically with the palm of the hand facing fore or aft, rather than the more natural position of the palm turned inward facing the user's body.

In addition to the problems related to handles, the traditional shopping baskets are not ergonomically shaped, generally having straight sides which do not conform to the curve of a user's body. If the basket is held close to the body, the straight rigid sides make the baskets awkward and uncomfortable to carry and walk with.

Some attempts have been made to address the deficiencies and uncomfortable nature of these hand-baskets and shoppers' displeasure with them. Some have fit pieces of tubing, foam, vinyl, etc., over the grip portion in efforts to make the handles less painful to hold. These attempted solutions only slightly increased the diameters of the handles, did little to decrease pinching between the two handles, and completely failed to address the many other problems (such as handle length, shape of the basket, point-of-contact with the body, swinging, etc.). Baskets with traditional plastic handles also tend to break at the pivot points where the handles connect to the basket.

There is a need for a hand-held shopping basket that is comfortable for a user to hold and carry.

There is a need for a hand-held shopping basket that has a handle of proper thickness and orientation that is comfortable for a user to carry.

There is a need for a hand-held shopping basket that is shaped to conform to the body of an average adult human, allowing for comfortable walking while carrying the basket.

There is a need for a hand-held shopping basket that allows a user to comfortably hold the weight of the user's groceries closer to the user's body to decrease torque on the user's back, and with the palm turned inward to decrease torque on the user's elbow and wrist.

There is a need for a hand-held shopping basket that has a dividing element projecting from the bottom surface, decreasing the tendency of heavy items to slide around in the basket.

There is a need for a hand-held shopping basket that can be stacked neatly and easily, without the need to fold away handles that may otherwise obstruct stacking.

These needs may be satisfied by a novel basket of the present invention.

SUMMARY OF THE INVENTION

The invention is directed to a stackable ergonomic hand-held shopping basket that satisfies the above-identified needs. A shopping basket having features of the present invention includes a bottom wall having upstanding side and end walls. The proximal side wall (closest to the user's body) is inwardly curved in a contour adapted to an adult human user's body. The opposite or distal side wall may also be curved with a contour that is symmetrical with the proximate side wall. The side walls and end walls have an outwardly-turned peripheral top edge forming a lip, the lip being extended downward along at least a portion of the proximal side wall to form a cushion portion. A centrally located handle projects from the bottom wall and defines a channel through the bottom wall of the basket for stacking baskets. The grip of the handle is oriented along the longitudinal axis of the basket.

DETAILED DESCRIPTION OF THE PREFERRED EMBODIMENT

Figure 1:
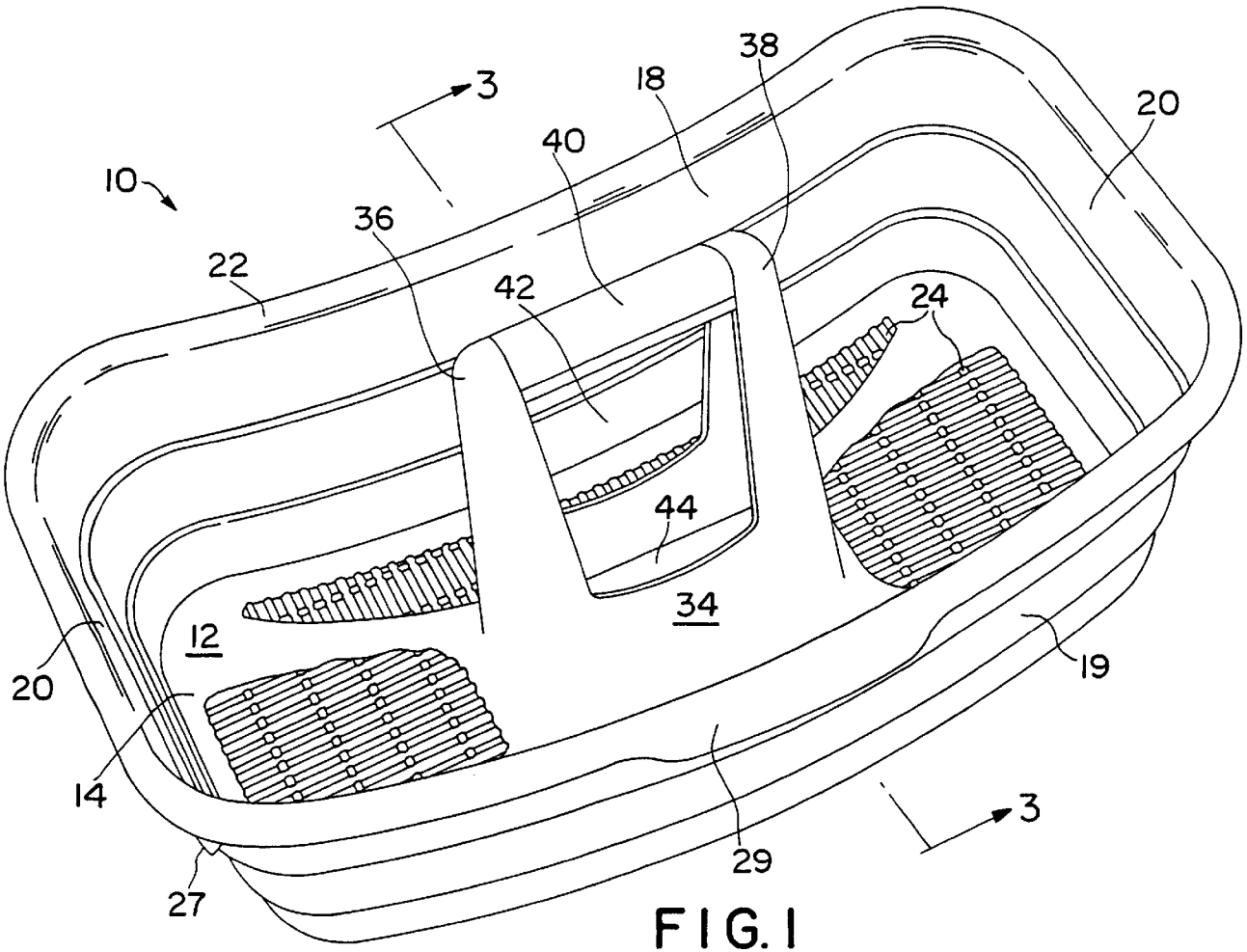
FIG. 1 shows a top isometric view of a hand-held shopping basket made in accordance with the present invention.

Referring to the drawings, wherein like numerals refer to like elements, the present invention generally comprises a stackable, ergonomic hand-held shopping basket 10 contoured to the shape of an average adult human user's natural body curve and having a centrally located handle projecting from the bottom. The basket is preferably constructed of thermo-plastic material by injection molding process.

Figure 2:
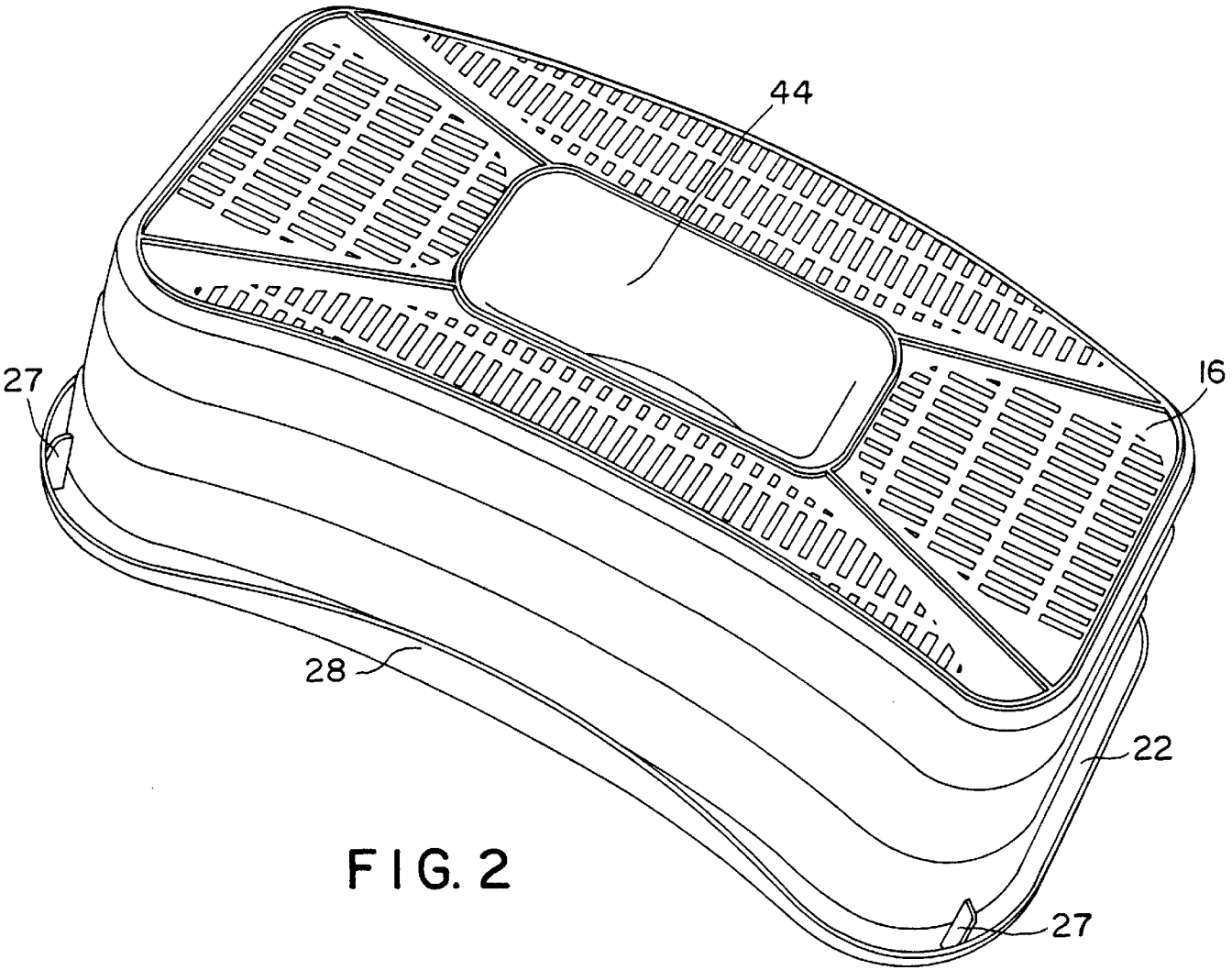
FIG. 2 shows a bottom isometric view of the hand-held shopping basket of FIG. 1.
Figure 3:
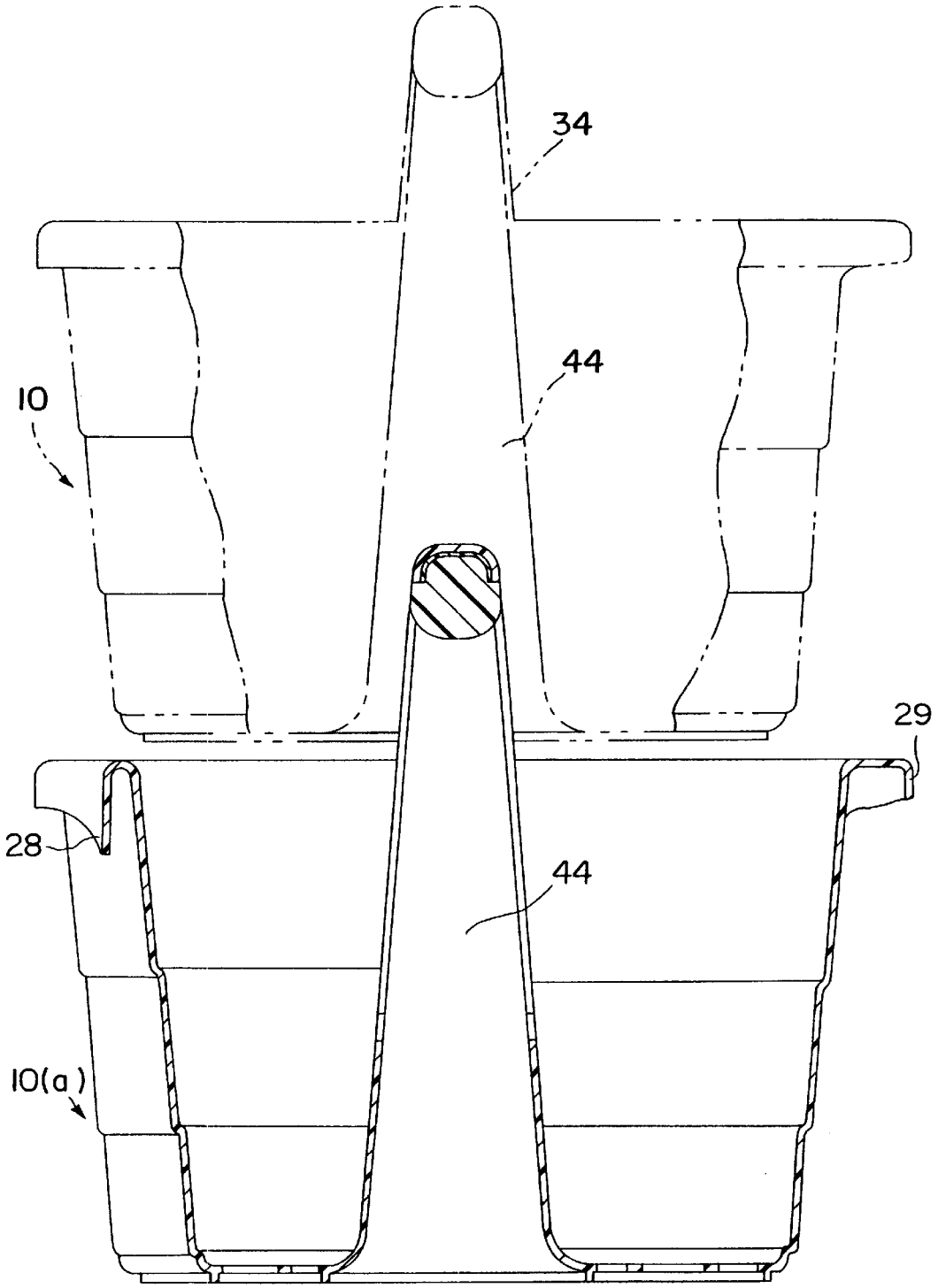
FIG. 3 shows a partial cutaway side view of the hand-held shopping basket of FIG. 1 shown in an about to be nested position with a substantially identical basket.

As shown in FIGS. 1 and 2, the shopping basket has a bottom 12 having an inner side 14 and an outer side 16. Extending upwardly from the inner side 14 of the bottom 12 are opposed side walls 18, 19 and end walls 20 defining a cavity adapted to receive items. For ease of description and differentiation, the side wall 18 to the top of FIG. 1 is the wall intended to be proximate to the user's body when carried, and may be referred to in this description and in the claims as the proximal side or proximal side wall 18. The opposite side wall may be referred to as the distal side or distal side wall 19. The side walls 18, 19 and the end walls 20 slope generally outwardly from the center of the basket 10, providing a basket that can be stacked with an identical basket 10(*a*) in a nested arrangement, as shown in FIG. 3.

The proximal side wall 18 curves inwardly towards the center of the shopping basket 10 in a contour adapted to the shape of an adult user's natural body curve, so the basket can be held comfortably against the user's body. As used in this description and the claims, the term curved is intended to encompass a smooth curvature such as shown in the drawings, and also to encompass an effective curvature which can be obtained by straight surfaces angled inward toward the longitudinal axis of the basket. When the basket is carried by a user with the curved proximal side wall facing the side of the user's body, such orientation shifts the center of gravity of the load closer to the user, and spreads the point of contact with the user's body over a larger surface area than contact with a straight side wall. The curvature is adapted to an adult user's natural body curve in the sense that the basket will normally be along the side of the body at the mid to lower thigh region, and must accommodate fore and aft movement of the thigh during walking. The basket can also be held against the torso along the upper hip area using the alternative finger grip described below. These considerations usually result in a relatively long and shallow curvature.

The side walls 18, 19 and end walls 20 have an outwardly-turned peripheral top edge to form a lip 22. In one embodiment of the present invention, as shown in FIG. 2, the lip is extended further downward along the proximal side wall to form a cushion portion 28 to further spread the point of contact and make the contact against a yielding surface.

The distal side wall 19 may be straight, or also be curved inward, but in the depicted embodiment the distal side wall is curved outward away from the longitudinal axis of the basket. In a preferred embodiment, the distal side wall has an outward curvature substantially symmetrical to the inward curvature of the proximal side wall 18. The lip on the distal side wall may have a short center extension wherein the lip is extended outward along a center section of the distal side wall to form a finger grip 29. The finger grip 29 allows the user an alternative means to grasp the basket, usually while pressing the proximal side wall against the torso. The finger grip 29 also acts as a bumper and shield for advertising material beneath it, as described hereafter.

Figure 6:
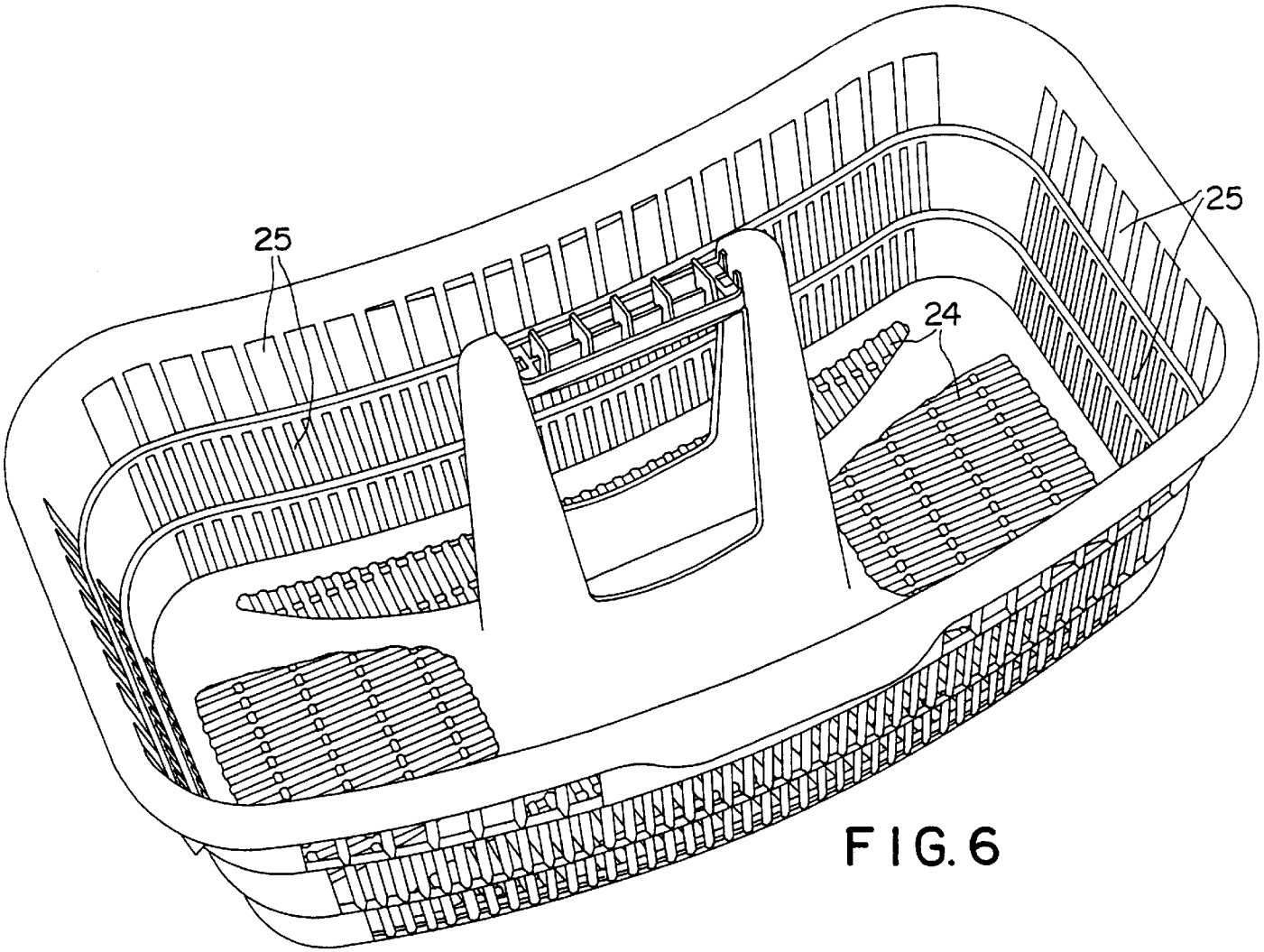
FIG. 6 shows a top isometric view of an alternate embodiment with additional ventilation slots of a hand-held shopping basket made in accordance with the present invention.

The basket bottom 12 may be provided with ventilation slots 24, as shown in FIGS. 1 and 2, to prevent the trapping of air between adjacent baskets while nesting and allow drainage from the basket. The side walls 18 or end walls 20 may also have ventilation slots 25, as shown in the embodiment in FIG. 6. These slots 24, 25 also reduce the amount and weight of plastic material, and hence the cost of the basket.

Figure 5:
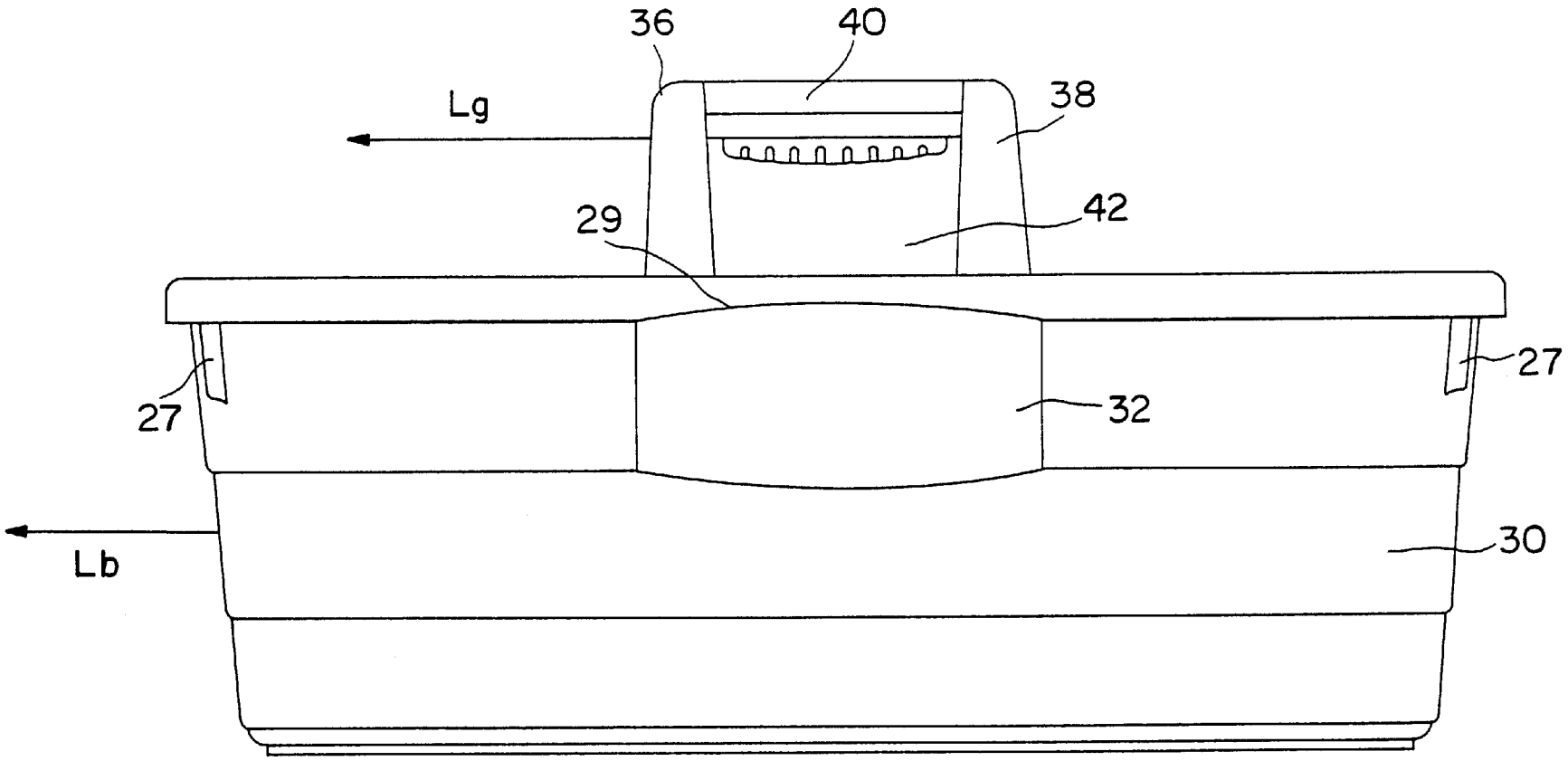
FIG. 5 shows a side elevational schematic view of an embodiment of a hand-held shopping basket made in accordance with the present invention.

In one of the embodiments of the present invention, shown in FIG. 5, the distal side wall 30 has a display panel 32. In the depicted embodiment, the display panel 32 is a smooth surface (no ventilation slots) where advertising may be displayed. A transparent cover (not shown) may be placed over the display panel 32, creating a pocket for receiving advertising sheets. Alternatively, the owner (such as a supermarket chain) may have its name printed or embossed on the panel to reduce theft and to promote the store's name. The finger grip 29 previously described acts as a bumper and shield for display panel, transparent cover, and advertising material.

Standoff fins 27 are located along the periphery of the basket, between the side walls 18 and the lip 22, and the end walls 20 and the lip 22. Although shown primarily at the corners in the depicted embodiments, the standoff fins may be located at other spaced intervals. The standoff fins act as points of contact with the lip of a lower nested basket when the baskets are stacked, and thus can be placed at many combinations of regular locations. However, these standoff fins 27 are not provided beneath the cushion portion 28, thus allowing the cushion portion 28 to flex and cushion impact with the user's body.

A centrally located handle 34 extends upwardly from the bottom wall 12. The handle 34 comprises a first upstanding post 36, a second upstanding post 38, and a grip portion 40. The grip portion 40 extends between and connects the upstanding posts, defining a hand-receiving opening 42 so that a user may grasp the grip portion. The handle 34 is oriented so that the longitudinal axis $L_g$ of the grip portion 40 is substantially aligned with, herein parallel to and above, the longitudinal axis $L_b$ of the basket, as shown in the FIG. 5. This orientation provides for a more natural and comfortable grip by the user, much like carrying a suit case.

Figure 4:
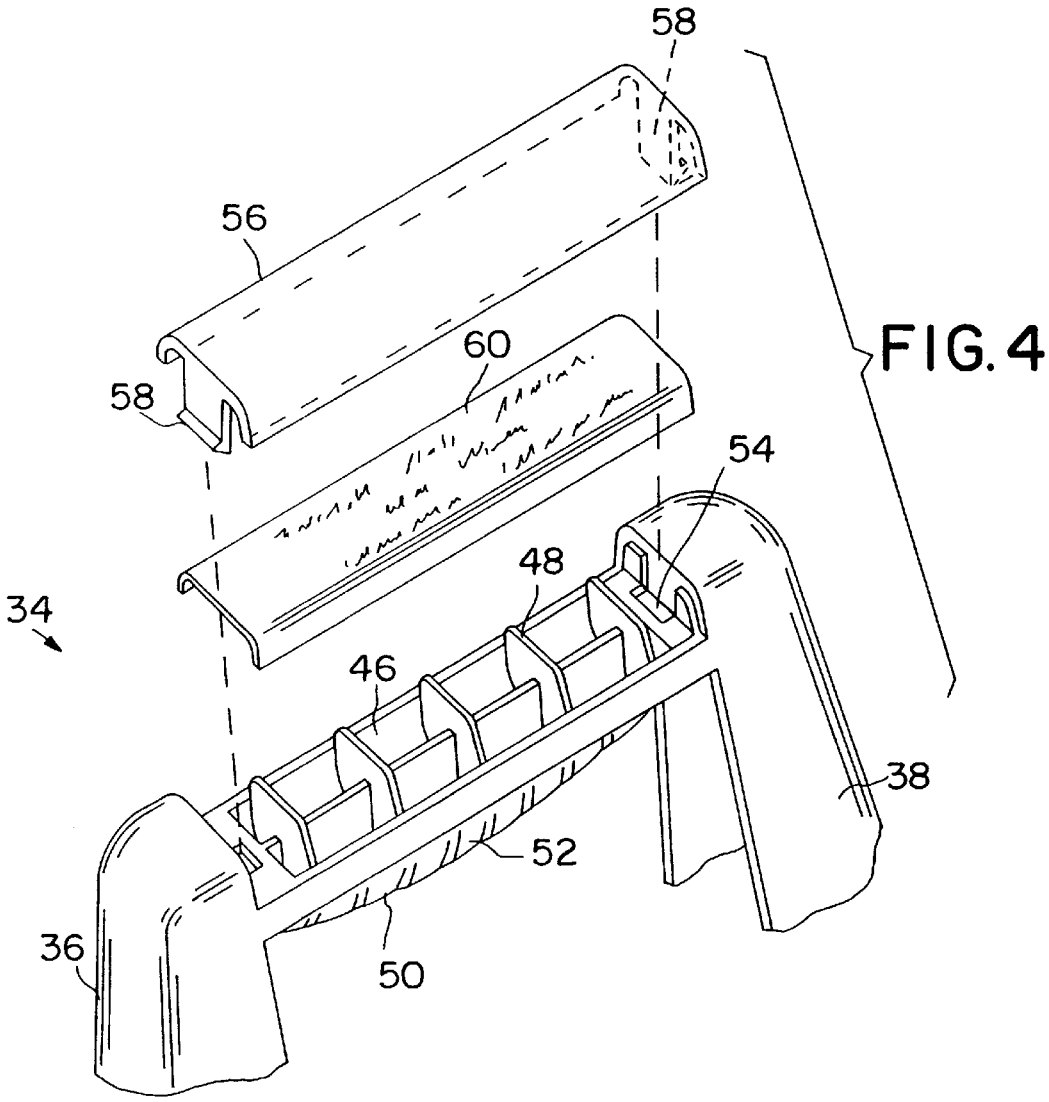
FIG. 4 shows an exploded view of an embodiment of the handle of a hand-held shopping basket made in accordance with the present invention.

The first upstanding post 36 and second upstanding post 38 are generally rounded at their top edge, as shown in FIG. 4. The handle 34 may also be formed so that the first upstanding post 36 and second upstanding post 38 slope outwardly toward the bottom wall 12 (i.e. narrow as they rise from bottom to top). This provides an inherent tendency to self-align as one basket is nested on top of another basket.

The handle 34 defines a channel 44 which extends through the bottom 12 of the basket and is open to the outer side 16 of the bottom 12. As shown in FIGS. 2 and 3, this channel 44 is adapted to receive the handle 34 of a substantially identical shopping basket 10 when the baskets are stacked in a nesting condition.

As shown in FIG. 4, the grip portion 40 comprises a hollow channeled body portion 46 having a longitudinal center beam crossed by lateral reinforcing webs 48, and a lower portion 50 contoured to provide a gripping surface 52. The body portion 46 has slots 54 located adjacent the first upstanding post 36 and the second upstanding post 38. A detachable cover 56 is provided with flanges 58 adapted to removably engage through the slots 54. When the gripping portion 40 is assembled, it produces a robust, thick, ergonomically shaped and comfortable handle that provides the user substantial control of basket movement.

Because the handle need not be folded away for stacking, it is kept to a relatively short vertical dimension above the cavity of the basket to raise the basket higher on the user's body when carried and give the user more control with less torque. Preferably the handle should extend above the lip of the basket, but not more than about eight inches above the lip of the basket. The handle also serves as a dividing element, decreasing the tendency of heavy items to slide around. In a preferred scaling, the areas in front and behind the handle (between the handle and the end walls) are each the approximate size of a one gallon plastic milk container.

As also shown in FIG. 4, a display plate 60 may be disposed in the grip between the hollow channeled body portion 46 and the cover 56, and is supported by the reinforcing webs 48. The display plate 60 is adapted to support or contain advertising material. In this embodiment, the cover 56 is made of a transparent material, so that the advertising may be viewed.

The basket 10 may be injection molded in a one-piece or two-piece injection mold thermo-plastic construction.

The present invention may be embodied in other specific forms without departing from the spirit or essential attributes thereof and, accordingly, reference should be made to the appended claims, rather than to the foregoing specification, as indicating the scope of the invention.

What is claimed is:

1. A hand-held basket comprising:

a bottom, a proximal side wall, a distal side wall, and two end walls defining a cavity, wherein the side walls and end walls have an outwardly-turned peripheral top edge forming a lip, the lip being extended downward along a portion of the proximal side wall a distance greater than the lip extends downward along the end walls to form a cushion portion, the cushion portion defining a smoothly curved surface of which the lower edge is an extension of the lip.

2. A hand-held basket as in claim 1, wherein the cavity has a longitudinal axis and the proximal side is curved inwardly towards the axis in a contour adapted to an adult human body.

3. A hand-held basket according to claim 2, wherein the lip is extended outward along a center section of the distal side wall to form a finger grip.

4. A hand-held basket as in claim 2, wherein the distal side wall is curved outwardly from the axis in a contour substantially symmetrical to the contour of the proximal side wall.

5. A hand-held basket comprising:

(a) a bottom, a proximal side wall, a distal side wall, and two end walls defining a cavity, wherein the cavity has a longitudinal axis and the proximal side is curved inwardly towards the axis in a contour adapted to an adult human body, (b) a handle attached to and projecting upward from the bottom, the handle being laterally spaced from the walls and extending upward through the cavity, and having a grip portion positioned above the cavity.

6. A hand-held basket as in claim 5, wherein the distal side wall is curved outwardly from the axis in a contour substantially symmetrical to the contour of the proximal side wall.

7. A hand-held basket as in claim 6, wherein the side walls and end walls have an outwardly-turned peripheral top edge forming a lip.

8. A hand-held basket as in claim 7, wherein the lip is extended downward along at least a portion of the proximal side wall to form a cushion portion.

9. A hand-held basket according to claim 7, wherein the lip is extended outward along a center section of the distal side wall to form a finger grip.

10. A hand-held basket as in claim 8, wherein stand-off fins are provided along the periphery of the basket between the lip and the end walls and side walls other than the cushion portion.

11. A hand-held basket as in claim 5, wherein the handle defines a channel which extends through the basket bottom, the channel being adapted to receive the handle of a substantially identical basket nesting directly below in a stack.

12. A stackable hand-held basket comprising:

(a) a bottom, a proximal side wall, a distal side wall, and two end walls defining a cavity, wherein the side walls and end walls have an outwardly-turned peripheral top edge forming a lip, the lip being extended downward along the proximal side wall to form a cushion portion, the cushion portion defining a smoothly curved surface of which the lower edge is an extension of the lip; and (b) a handle attached to and projecting upward from the bottom and laterally spaced from the walls, the handle defining a channel which extends through the basket bottom, the channel being adapted to receive the handle of a substantially identical basket nesting directly below in a stack.

13. A stackable hand-held basket as in claim 12, wherein the cavity has a longitudinal axis and the proximal side is curved inwardly towards the axis in a contour adapted to an adult human body.

14. A stackable hand-held basket as in claim 13, wherein the distal side wall is curved outwardly from the axis in a contour substantially symmetrical to the contour of the proximal side wall.

15. A stackable hand-held basket as in claim 14, wherein the lip is extended outward along a center section of the distal side wall to form a finger grip.

16. A stackable hand-held basket as in claim 12, further comprising the handle extending from the bottom of the basket to a grip portion positioned higher than the top edge of the proximal side wall.

17. A stackable hand-held basket as in claim 16, wherein a longitudinal axis of the grip portion is substantially aligned with the longitudinal axis of the basket.

18. A stackable hand-held basket comprising:

a bottom, a proximal side wall, a distal side wall, and two end walls defining a cavity, wherein the cavity has a longitudinal axis, the proximal side is curved inwardly towards the axis in a contour adapted to an adult human body, and the side and end walls taper inward toward the cavity for at least a portion of the height of each wall such that the cavity is at least partially nestable within the cavity of a substantially identical basket located directly below; and a handle attached to and projecting upward from the bottom into the cavity and being laterally spaced from the walls, the handle defining a channel which extends through the basket bottom, the channel being adapted to receive the handle of the substantially identical basket nesting directly below.

19. A stackable hand-held basket as in claim 18, further comprising the handle extending from the bottom of the basket to a grip portion positioned higher than the top edge of the proximal side wall.

20. A stackable hand-held basket as in claim 18, wherein a longitudinal axis of the grip portion is substantially aligned with the longitudinal axis of the basket.

21. A hand-held basket as in claim 18, wherein at least one side wall has a display panel.

22. A hand-held basket as in claim 21, further comprising a transparent cover over the display panel, the display panel and transparent cover defining a pocket adapted to receive removable advertising sheets.

23. A stackable hand-held basket comprising:

(a) a bottom, a proximal side wall, a distal side wall and a pair of end walls defining a cavity, wherein the cavity has a longitudinal axis and the walls taper inward toward the cavity for at least a portion of the height of each wall such that the cavity is at least partially nestable within the cavity of an identical basket located below;

(b) a handle attached to and projecting upward from the bottom, the handle being spaced apart from the walls and extending upward through the cavity, the handle comprising:

(i) first and second upstanding posts, and (ii) a grip portion connecting the first upstanding post and the second upstanding post; and (c) the handle defining a channel extending through the bottom, the channel adapted to receive the handle of the identical basket nesting directly below.

24. A stackable hand-held basket as in claim 23, further comprising the channel being aligned substantially on the longitudinal axis.

25. A stackable hand-held basket as in claim 24, further comprising a longitudinal axis of the grip portion being substantially parallel to the longitudinal axis.

26. A stackable hand-held basket as in claim 23, wherein the side walls and end walls slope generally outwardly from the center of the basket.

27. A stackable hand-held basket as in claim 23, wherein the proximal side is curved inwardly towards the longitudinal axis in a contour adapted to an adult human body.

28. A stackable hand-held basket as in claim 23, wherein the side walls and end walls have an outwardly-turned peripheral top edge forming a lip, the lip being extended downward along at least a portion of the proximal side wall to form a cushion portion.

29. A stackable hand-held basket as in claim 28, wherein stand-off fins are provided along the periphery of the basket between the lip and the end walls and side walls other than the cushion portion.

30. A stackable hand-held basket as in claim 23, wherein the first upstanding post and the second upstanding post slope outwardly as they intersect the bottom wall.

* * * * *